US007786683B2

(12) United States Patent
Busse et al.

(10) Patent No.: US 7,786,683 B2
(45) Date of Patent: Aug. 31, 2010

(54) CIRCUIT ARRANGEMENT AND METHOD FOR OPERATING AT LEAST ONE ELECTRIC LAMP AND AT LEAST ONE LED

(75) Inventors: Olaf Busse, München (DE); Markus Heckmann, München (DE); Reinhard Lecheler, Neuburg/Donau (DE); Alfons Lechner, Hohenwart (DE); Siegfried Mayer, Moosinning (DE); Thomas Pollischansky, Stadtbergen (DE); Bernd Rudolph, Forstern (DE); Bernhard Schemmel, Wessling (DE); Kay Schmidtmann, München (DE); Harald Schmitt, München (DE); Thomas Siegmund, Otterfing (DE); Arwed Storm, Dachau (DE); Horst Werni, München (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 103 days.

(21) Appl. No.: 11/475,095

(22) Filed: Jun. 27, 2006

(65) Prior Publication Data

US 2007/0210719 A1 Sep. 13, 2007

(30) Foreign Application Priority Data

Jun. 28, 2005 (DE) ..... 10 2005 030 114

(51) Int. Cl.
*H05B 39/00* (2006.01)

(52) U.S. Cl. ..... 315/312; 315/177; 315/200 R

(58) Field of Classification Search ..... 315/185 S, 315/200 A, 312–326
See application file for complete search history.

(56) References Cited

U.S. PATENT DOCUMENTS

| | | | | |
|---|---|---|---|---|
| 4,536,695 | A * | 8/1985 | Lin | 320/136 |
| 5,781,418 | A * | 7/1998 | Chang et al. | 363/16 |
| 6,072,285 | A * | 6/2000 | Chen | 315/307 |
| 6,380,693 | B1 * | 4/2002 | Kastl | 315/209 R |
| 6,429,597 | B1 * | 8/2002 | Flory et al. | 315/129 |
| 6,717,371 | B2 * | 4/2004 | Klier et al. | 315/274 |
| 2003/0112229 | A1 * | 6/2003 | Pong et al. | 345/204 |
| 2006/0238174 | A1 * | 10/2006 | Russell et al. | 323/229 |
| 2006/0284569 | A1 * | 12/2006 | Wey et al. | 315/282 |

FOREIGN PATENT DOCUMENTS

| | | | |
|---|---|---|---|
| DE | 100 13 207 | A1 | 9/2001 |
| EP | 1 076 476 | A2 | 2/2001 |
| WO | 2004/097866 | A1 | 11/2004 |

* cited by examiner

*Primary Examiner*—Douglas W Owens
*Assistant Examiner*—Jianzi Chen

(57) ABSTRACT

The present invention relates to a circuit arrangement for operating at least one electric lamp and at least one LED including: an inverter having a bridge circuit having at least one first bridge transistor and one second bridge transistor arranged in series with one another, a center point of the bridge circuit being defined between the first and second bridge transistors; a lamp supply unit for supplying the electric lamp with energy from the bridge circuit, which includes a supply line with an inductance, via which the center point (M) of the bridge circuit is coupled to a first connection for the electric lamp; the lamp supply unit including an LED supply unit, which is designed to supply the at least one LED with energy. Moreover, it relates to an operating method for at least one electric lamp and at least one LED using such a circuit arrangement.

12 Claims, 3 Drawing Sheets

CIRCUIT ARRANGEMENT AND METHOD FOR OPERATING AT LEAST ONE ELECTRIC LAMP AND AT LEAST ONE LED

TECHNICAL FIELD

The present invention relates to a circuit arrangement for operating at least one electric lamp and at least one LED (light-emitting diode), comprising an inverter having a bridge circuit having at least one first bridge transistor and one second bridge transistor which are arranged in series with one another, a center point of the bridge circuit being defined between the first bridge transistor and the second bridge transistor, and a lamp supply unit for supplying the electric lamp with energy from the bridge circuit, which comprises a supply line with an inductance, via which the center point of the bridge circuit is coupled to a first connection for the electric lamp. Moreover, it relates to a corresponding operating method for at least one electric lamp and at least one LED using such a circuit arrangement.

PRIOR ART

The problem on which the present invention is fundamentally based consists in both electric lamps, for example fluorescent lamps, and LEDs being operated in one illumination unit, in order to achieve particular visual effects, for example in order to realize an emergency lighting function or a nightlight function of an illumination unit or in order to vary the color temperature. For this purpose, two ballasts are used in the prior art, to be precise a ballast for the light-emitting diodes and a second ballast for the fluorescent lamps. In this case, the manufacturer of such an illumination unit connects the two ballasts via corresponding lines to the system connection of the illumination unit. Disadvantages of this known solution are the wiring complexity involved for the manufacturer of such an illumination unit and the space requirement involved owing to the two ballasts in such an illumination unit.

SUMMARY OF THE INVENTION

The object of the present invention therefore consists in developing the circuit arrangement mentioned initially and the operating method mentioned initially such that a reduction in the wiring complexity and a reduction in the space requirement of the unit(s) used for driving the electric lamps and the LEDs is possible.

The present invention is based in principle on the knowledge that the disadvantages of the prior art can be overcome if the at least one electric lamp and the at least one LED are operated with one and the same ballast. This is because firstly this requires only this one ballast to be wired to the system connection. Secondly, such a ballast requires less space than the two ballasts which were required in the procedure in accordance with the prior art, in particular if specific components are used both for the operation of the at least one electric lamp and for the operation of the at least one LED. In order to realize the nightlight function, in the case of which only the at least one LED is intended to illuminate, the bridge circuit may be operated at a frequency which is higher than the frequency during normal operation, in the case of which, however, the starting condition for the electric lamp is not yet met. In this case, optional preheating for the filaments should be deactivated.

In order to limit the current through the at least one LED, a nonreactive resistor and/or an inductance may be connected in series with the at least one LED.

One preferred embodiment is characterized by the fact that the LED supply unit has an input and an output, the input and the output being DC-isolated from one another as regards their potentials. Owing to the DC-isolation, it is ensured that no direct current is transmitted from the input of the LED supply unit to the output of the LED supply unit. This measure makes it possible, in a simple manner, to adhere to the safety regulations envisaged for many applications or in diverse countries for the operation of LEDs.

The LED supply unit particularly preferably comprises a transformer, which is coupled to the supply line, in particular to the center point of the bridge circuit. During operation, an AC voltage having a constant amplitude is thus applied to the primary side of the transformer and consequently also to the secondary side of the transformer. The amplitude of the AC voltage on the secondary side can be fixed by means of the selection of the turns ratio. As a result of the voltage on the secondary side of the transformer, a typical current through the LED and thus a specific color temperature results, via the characteristic for the at least one LED.

A particularly space-saving implementation can be achieved if the inductance in the supply line of the electric lamp represents the primary winding of this transformer.

The LED supply unit may also comprise a capacitive voltage divider, which is connected to the supply line, in particular to the center point of the bridge circuit. In this case, the capacitive voltage divider replaces the abovementioned transformer and likewise ensures that no direct current is transmitted from the input to the output of the LED supply unit. Possible capacitive voltage dividers as regards good insulation properties are, in particular, so-called X or Y capacitors.

Furthermore, a voltage limitation apparatus, in particular a zener diode, is preferably connected in parallel with the at least one LED. In particular in the embodiment mentioned above, in which the inductance in the supply line of the electric lamp represents the primary winding of the transformer, such a voltage limitation apparatus ensures that the at least one LED is protected against overload owing to excessively high voltages during starting operation of the electric lamp.

The LED supply unit preferably also comprises a rectifier, which is designed to provide a rectified signal at the output of the LED supply unit, i.e. at the connection at which the at least one LED is connected to the LED supply unit.

In order to smooth the current in the LEDs, a smoothing inductor can advantageously be inserted in series in the current path of the LEDs.

Further advantageous embodiments are described in the dependent claims.

The preferred embodiments and advantages described above with reference to the circuit arrangement according to the invention apply in a corresponding manner to the operating method according to the invention.

BRIEF DESCRIPTION OF THE DRAWINGS

Two exemplary embodiments of a circuit arrangement according to the invention will now be described in more detail below with reference to the attached drawings, in which.

PREFERRED EMBODIMENT OF THE INVENTION

Figure 1:
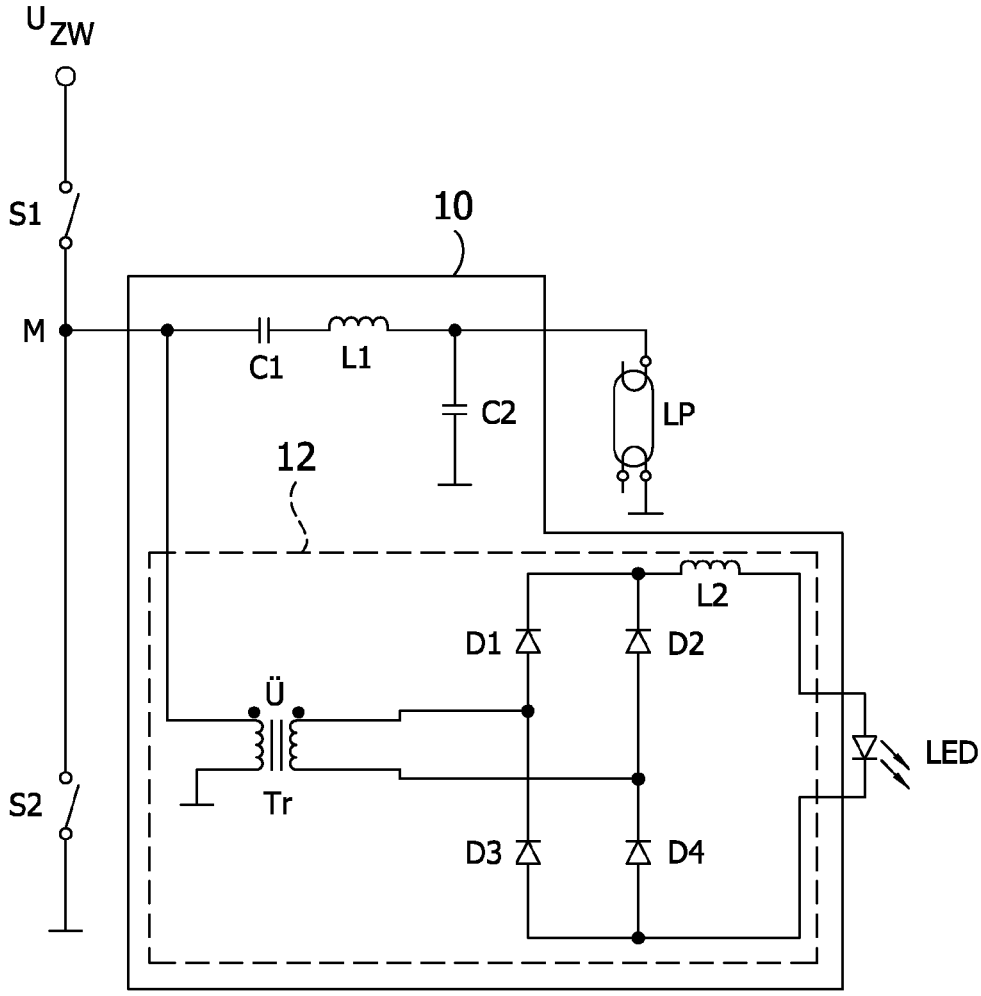
FIG. 1 shows a first exemplary embodiment of a circuit arrangement according to the invention.

FIG. 1 shows a schematic illustration of a first exemplary embodiment of a circuit arrangement according to the invention, for reasons of clarity only the components relevant to the invention being illustrated. A so-called intermediate circuit voltage $U_{ZW}$ is applied to the series circuit comprising a first switch S1, implemented by a first bridge transistor, and a second switch S2, implemented by a second bridge transistor, said intermediate circuit voltage, as is generally known, being produced from the system voltage and generally being of the order of magnitude of 400 V. In the present exemplary embodiment, a half-bridge circuit is used as the bridge circuit. However, as is obvious to a person skilled in the art, the invention can also be implemented using a full-bridge circuit. The switches S1 and S2 are driven in a known manner so as to implement an inverter. A center point M of the bridge circuit is defined between the two switches S1, S2. A lamp supply unit 10, which is used for the supply to an electric lamp LP, is connected to the bridge center point M. It comprises a coupling capacitor C1, an inductance L1 and a resonant capacitor C2. According to the invention, it also comprises an LED supply unit 12, which is designed to supply the LED with energy. The LED supply unit 12 comprises a transformer Tr having a transformation ratio Ü, whose primary side is coupled to the center point M of the bridge circuit and whose secondary side is coupled to a rectifier, which comprises the diodes D1 to D4, the output of the rectifier being coupled to the LED. The properties of the light output by the LED, in particular the color temperature and the brightness, can be set by selecting the transformation ratio Ü of the transformer Tr.

Figure 2:
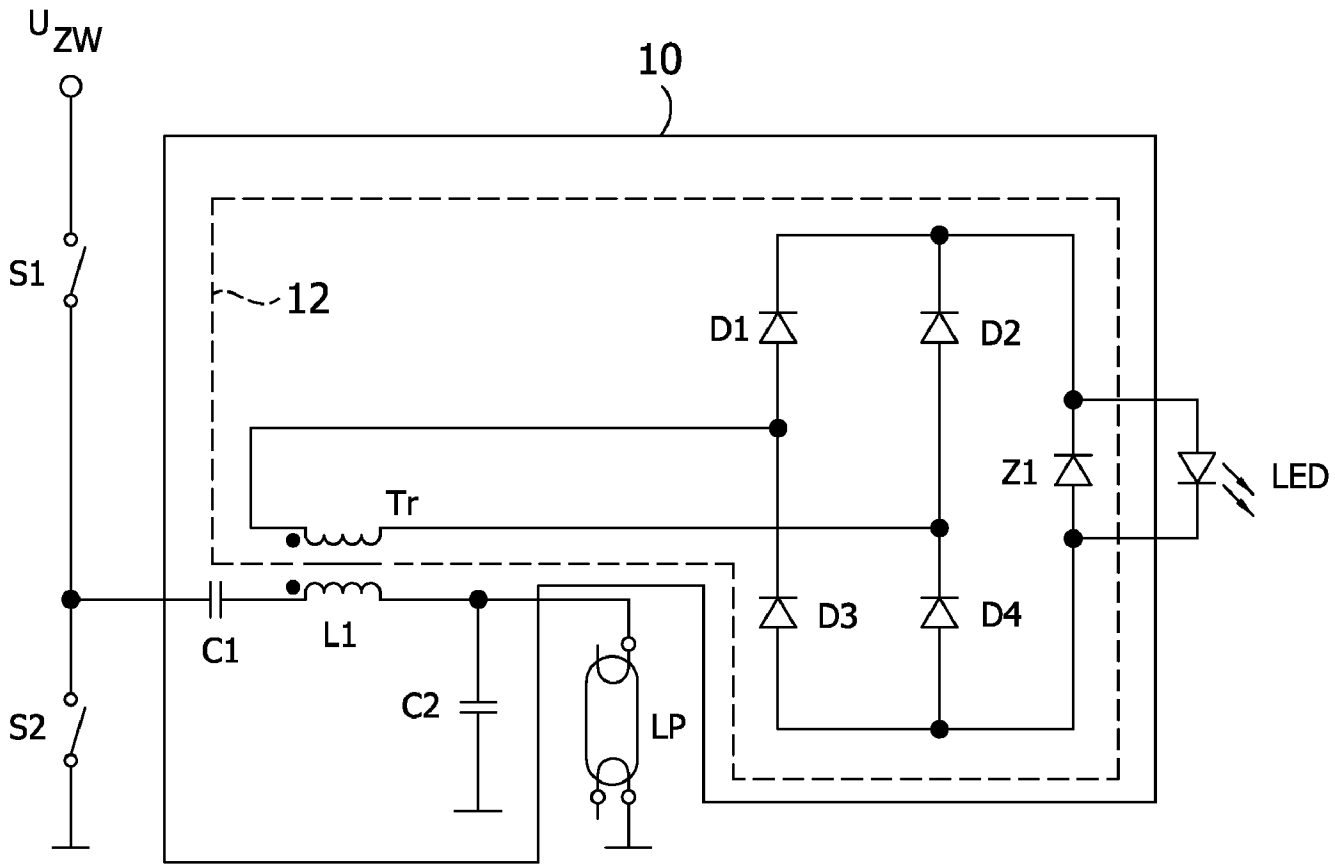
FIG. 2 shows a second exemplary embodiment of a circuit arrangement according to the invention.

FIG. 2 shows a schematic illustration of the relevant components of a second exemplary embodiment of a circuit arrangement according to the invention, the same reference symbols as have already been used with reference to FIG. 1 being used for components which correspond to those in FIG. 1. In the exemplary embodiment illustrated in FIG. 2, the inductance L1 in the supply line of the electric lamp LP represents the primary winding of the transformer Tr. In order to implement the transformer Tr, in this case the secondary transformer winding is applied to the inductance L1. Since the LED would be operated during preheating operation and during starting operation of the electric lamp LP with a different current, during starting operation in particular with a higher current, than as envisaged for the running operation, a voltage limitation apparatus, in this case a zener diode Z1, is arranged in parallel with the LED in order to protect the LED against overload owing to excessively high voltages, in particular during starting operation.

Figure 3:
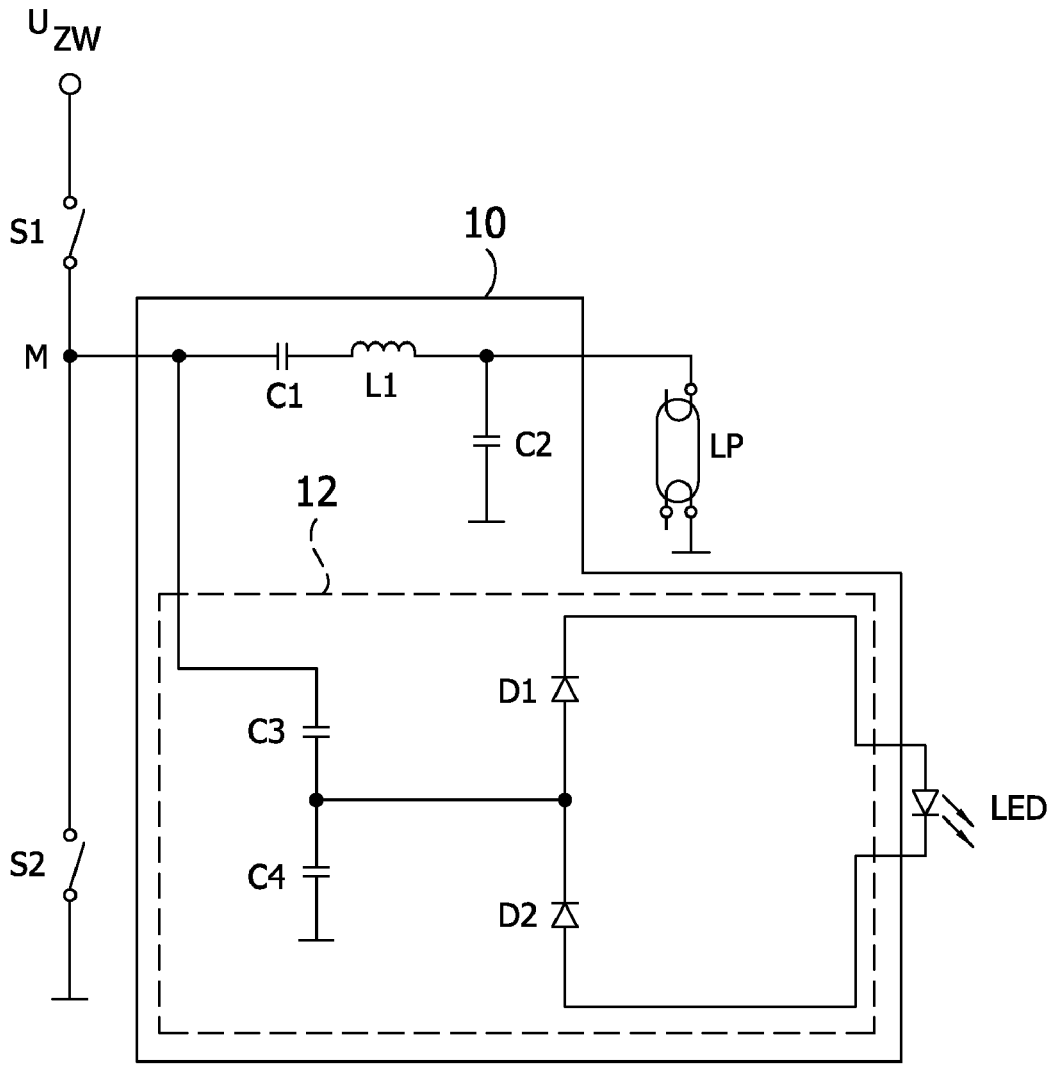
FIG. 3 shows a third exemplary embodiment of a circuit arrangement according to the invention.

FIG. 3 shows a schematic illustration of the relevant components of a third exemplary embodiment of the invention. The components having reference symbols corresponding to the reference symbols in FIG. 1 have corresponding functions. Capacitors C3 and C4 form a capacitive voltage divider which is electrically connected to the inverter at the center point M. An output of the capacitive voltage divider (i.e., the connection between capacitors C3 and C4) provides energy to the LED through the rectifier formed by diodes D1 and D2.

The invention claimed is:

1. A circuit arrangement for operating at least one electric lamp and at least one light emitting diode (LED) comprising:

an inverter having a bridge circuit including at least one first bridge transistor and at least one second bridge transistor which are arranged in series with one another, wherein a center point of the bridge circuit is the electrical connection between the first bridge transistor and the second bridge transistor; and a lamp supply unit for supplying a first connection of the electric lamp with energy from the bridge circuit, wherein a second connection of the electric lamp is connected to a ground of the lamp supply circuit, said lamp supply circuit comprising:

a supply line for transferring energy from the center point of the bridge circuit to the first connection for the electric lamp, said supply line including an inductance, and an LED supply unit for supplying the at least one LED with energy, wherein the LED supply unit comprises a transformer having a primary winding and a secondary winding;

the primary winding is directly electrically connected to the electric lamp, and the inductance in the supply line of the electric lamp is the primary winding of the transformer; and the secondary winding is coupled to the at least one LED.

2. The circuit arrangement of claim 1, wherein the LED supply unit comprises a capacitive voltage divider, which is connected to the supply line at the center point of the bridge circuit.

3. The circuit arrangement of claim 1, wherein a voltage limitation apparatus is connected in parallel with the at least one LED, said voltage limitation apparatus comprising a zener diode.

4. The circuit arrangement of claim 1, wherein the LED supply unit comprises a rectifier for providing a rectified signal at the output of the LED supply unit.

5. The circuit arrangement of claim 1, wherein a smoothing inductor is connected in series with the at least one LED.

6. The circuit arrangement of claim 1 wherein the output of the LED supply unit is DC-isolated from the input of the LED supply unit as regards their potentials.

7. A method of operating at least one electric lamp and at least one light emitting diode (LED), said method comprising:

driving a first bridge switch and a second bridge switch of a bridge circuit in order to provide energy at a center point of the bridge circuit from an input to the bridge circuit, wherein the center point is the electrical connection between the first bridge switch and the second bridge switch;

connecting a supply line of a lamp supply unit to the center point of the bridge circuit to transfer energy from the center point to a first connection for the electric lamp, wherein the supply line includes an inductance and the lamp supply unit includes an LED supply unit, and wherein a second connection for the electric lamp is connected to a ground of the lamp supply unit;

connecting an input of the LED supply unit to the supply line of the lamp supply unit to supply energy to the at least one LED from the supply line, and wherein the inductance of the supply line is the primary winding of a transformer and said the primary winding is directly electrically connected to the electric lamp and wherein the secondary winding is coupled to the at least one LED.

8. The method of claim 7 further comprising:

selecting a transformation ratio of a transformer in order to drive the LED at a predetermined color temperature and brightness, wherein the input of the LED supply unit is a primary winding of the transformer, and the LED is driven from the secondary winding of the transformer via a rectifier.

9. The method of claim 7 wherein the output of the LED supply unit is DC-isolated from the input of the LED supply unit as regards their potentials.

10. A ballast for providing energy to at least one electric lamp and at least one light emitting diode (LED) comprising:

an inverter having a bridge circuit including at least one first bridge transistor and at least one second bridge transistor which are arranged in series with one another, wherein a center point of the bridge circuit is the electrical connection between the first bridge transistor and the second bridge transistor; and a lamp supply unit for supplying the electric lamp with energy from the bridge circuit, said lamp supply circuit comprising:

a supply line for transferring energy from the center point of the bridge circuit to a first connection for the electric lamp, said supply line including an inductance, wherein a second connection for the electric lamp is connected to a ground of the lamp supply unit, and an LED supply unit for supplying the at least one LED with energy, said LED supply unit comprising a transformer having a primary winding and a secondary winding, wherein the primary winding is directly electrically connected to the electric lamp and the inductance in the supply line of the electric lamp is the primary winding of the transformer and wherein the secondary winding is coupled to the at least one LED.

11. The ballast of claim 10 wherein the input of the LED supply unit is the primary winding of the transformer and the LED is provided energy from the output of the secondary winding via a rectifier, and wherein a transformation ratio of the transformer is selected in order to drive the LED at a predetermined color temperature and brightness.

12. The ballast of claim 10 wherein the output of the LED supply unit is DC-isolated from the input of the LED supply unit as regards their potentials.

* * * * *